US005101584A

United States Patent [19]

Theurer et al.

[11] Patent Number: 5,101,584

[45] Date of Patent: * Apr. 7, 1992

[54] MOBILE BALLAST REGULATOR

[75] Inventors: Josef Theurer, Vienna; Herbert Wörgötter, Linz, both of Austria

[73] Assignee: Franz Plasser Bahnbaumaschinen-Industriegesellschaft m.b.H., Vienna, Austria

[ * ] Notice: The portion of the term of this patent subsequent to Mar. 10, 2009 has been disclaimed.

[21] Appl. No.: 666,729

[22] Filed: Mar. 8, 1991

[30] Foreign Application Priority Data

Mar. 21, 1990 [AT] Austria ..... 670/90

[51] Int. Cl.[5] ..... E02F 5/22

[52] U.S. Cl. ..... 37/104; 104/279

[58] Field of Search ..... 37/104, 105, 106, 107; 104/2, 279; 171/16

[56] References Cited

U.S. PATENT DOCUMENTS 3,612,184 10/1971 Plasser et al. .
4,227,324 10/1980 Theurer ..... 37/104
4,236,452 12/1980 Theurer et al. ..... 37/104 X
4,635,664 1/1987 Theurer et al. ..... 37/107 X
4,770,104 9/1988 Theurer ..... 37/104 X
4,794,862 1/1989 Theurer ..... 37/104 X
4,835,887 6/1989 Theurer ..... 37/104
4,967,847 11/1990 Whitaker, Jr. ..... 37/104 X

FOREIGN PATENT DOCUMENTS 1169721 11/1966 United Kingdom .

*Primary Examiner*—Dennis L. Taylor
*Assistant Examiner*—J. Russell McBee
*Attorney, Agent, or Firm*—Collard, Roe & Galgano

[57] ABSTRACT

A mobile ballast regulator comprises an elongated machine frame supported by undercarriages on the track, a ballast plow connected to the machine frame, a ballast storage container mounted on the machine frame, and a carrier frame which has a front end linked to the machine frame rear end for pivoting about axes extending vertically and transversely to the longitudinal direction of the elongated machine frame. A further undercarriage supports the carrier frame rear end for mobility on the track. A ballast sweeping and receiving arrangement comprises a ballast broom connected to the carrier frame for sweeping ballast off the track and a conveyor band having an input end arranged to receive the ballast swept by the broom.

8 Claims, 1 Drawing Sheet

MOBILE BALLAST REGULATOR

BACKGROUND OF THE INVENTION

1. Field of the Invention

The present invention relates to a mobile machine for distributing and planing ballast supporting a track, which comprises an elongated machine frame supported by undercarriages on the track for mobility in an operating direction, the machine frame having a rear end in this direction, a ballast plow connected to the machine frame, a ballast storage container mounted on the machine frame, a carrier frame linked to the machine frame, and a ballast sweeping and receiving arrangement comprising a ballast broom connected to the carrier frame for sweeping ballast off the track and a conveyor band having an input end arranged to receive the ballast swept by the broom.

2. Description of the Prior Art

A ballast distributing and planing machine of this type has been disclosed in U.S. Pat. No. 3,612,184, dated Oct. 12, 1971. The front end of the machine carries a plow for shaping and planing the ballast in the center of the track, and the ballast storage container is mounted on the machine frame between the undercarriages supporting the same on the track and receives ballast swept up from the ballast bed for storing therein and redistributes the stored ballast in desired areas of the track through controllable discharge openings in the bottom of the container. A ballast sweeping and receiving arrangement is arranged in the rear of the machine and comprises a ballast broom and an ascending conveyor band receiving ballast swept up by the broom. This arrangement is linked to an elongated carrier frame whose front end is mounted on the machine frame for pivoting about an axis extending transversely to the longitudinal direction of the elongated carrier frame and is connected to a vertical adjustment drive. This arrangement enables excess ballast to be swept off the track and to be conveyed by the ascending conveyor band to the storage container. The pivotal carrier frame supporting the ballast sweeping and receiving arrangement enables the same to be pivoted between a lowered operating position and a raised transit position.

British patent No. 1,169,721, published Nov. 5, 1969, discloses a mobile ballast surfacing machine with a ballast sweeping and receiving arrangement at the rear end of the machine and comprising two ballast brooms directing swept-up ballast into a loading shovel receiving the swept ballast. A pivotal arm carries the arrangement to enable the shovel to the emptied into a ballast storage container preceding the arrangement upon raising the carrier arm over the container. This arrangement operates without a ballast conveyor band but it is structurally rather complex.

SUMMARY OF THE INVENTION

It is the primary object of this invention to improve a mobile ballast distributing and planing machine of the indicated type in such a manner that the swept-up ballast is efficiently conveyed to the ballast storage container.

According to the invention, the ballast regulator comprises an elongated machine frame supported by undercarriages on the track for mobility in an operating direction, a ballast plow connected to the machine frame, a ballast storage container mounted on the machine frame, a carrier frame having a front end linked to the machine frame rear end for pivoting about axes extending vertically and transversely to the longitudinal direction of the elongated machine frame, a further undercarriage supporting the carrier frame rear end for mobility on the track, and a ballast sweeping and receiving arrangement comprising a ballast broom connected to the carrier frame for sweeping ballast off the track and a conveyor band having an input end arranged to receive the ballast swept by the broom.

Such a construction enables the carrier frame to be made relatively long and this, in turn, makes it possible to permit the conveyor band to ascend from the ballast broom to the ballast storage container at a relatively small angle and to space the broom a relatively large distance from the rear undercarriage supporting the machine frame on the track. The conveyor band extends between the ballast broom and the ballast storage container, and preferably ascends at an angle of about 15° to about 25° with respect to a horizontal plane. Such a conveyor band has a much larger conveying capacity than a steeply ascending conveyor. Furthermore, the further undercarriage supporting the rear end of the pivotal carrier frame on the track will automatically center the ballast broom over the track even in sharp track curves.

The ballast broom is preferably arranged below the carrier frame between the front and rear ends thereof. This enables the broom to be raised from an operating to a transit position without any problems and leaves the area above the carrier frame free to accommodate other devices.

According to a preferred feature of the present invention, a ballast conveying gutter is mounted on the carrier frame above the ballast broom, the gutter having a front discharge end and a rear input end in the operating direction, the rear input end of the gutter being arranged above the carrier frame and the front discharge end of the gutter being arranged above the input end of the conveyor band. This arrangement makes it possible, without interference with the ballast broom operation, to deliver additional ballast to the storage container, if required, use being made for this purpose of the conveyor band which conveys the swept-up ballast. The conveyance of the ballast from the input to the discharge end of the gutter will be improved by vibrating the ballast conveying gutter.

According to another preferred feature, the ballast sweeping and receiving arrangement further comprises a ballast conveying chute arranged below the front discharge end of the gutter and above the conveyor band input end, the chute preceding the ballast broom in the operating direction for receiving ballast swept off the track by the broom. This simple device assures a trouble-free delivery of the ballast from the discharge end of the ballast conveying gutter as well as from the ballast broom to the input end of the conveyor band.

Advantageously, the ballast broom is mounted on the carrier frame for pivoting about an axis extending transversely to the longitudinal direction of the elongated machine frame and above the ballast conveying chute, and is pivotal about this axis by a vertical adjustment drive linking the ballast broom to the carrier frame. In this way, the ballast conveying chute remains operative for delivering ballast from the chute to the conveyor band even when the ballast broom has been raised into its transit position.

Finally, an operator's cab may be mounted on the carrier frame adjacent the rear end thereof, the rear input end of the gutter being arranged above the cab. Such a cab makes it possible to advance the machine during transit to another operating site in a direction opposite to the operating direction and, at the same time, to control the operation of the ballast conveying gutter for delivering additional ballast to the ballast storage container during transit.

BRIEF DESCRIPTION OF THE DRAWING

The above and other objects, advantages and features of the present invention will become more apparent from the following description of a now preferred embodiment thereof, taken in conjunction with the accompanying, somewhat schematic drawing wherein.

DETAILED DESCRIPTION OF PREFERRED EMBODIMENT

Figure 1:
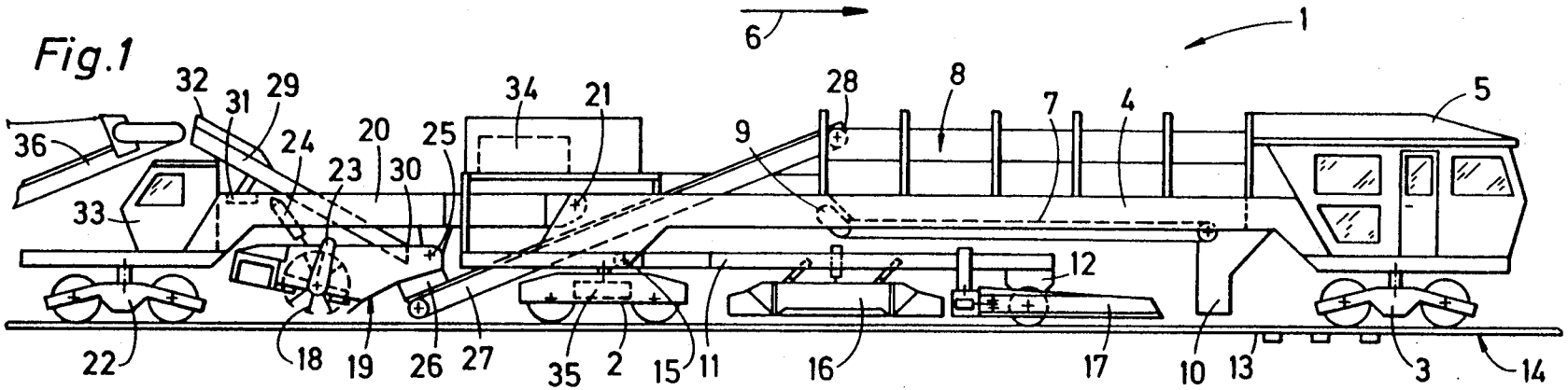
FIG. 1 is a side elevational view of a ballast regulator according to this invention.
Figure 2:
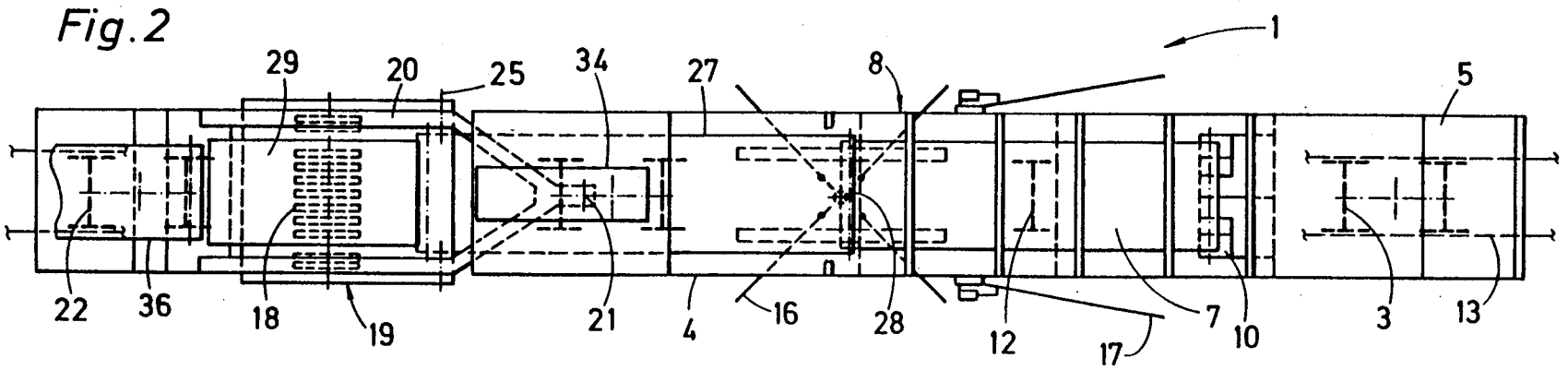
FIG. 2 is a diagrammatically simplified top view of the ballast regulator.

The drawing shows mobile machine 1 for distributing and shaping ballast supporting railroad track 14, which comprises elongated machine frame 4 extending in a longitudinal direction and supported by two undercarriages 2, 3 for mobility on the track in an operating direction indicated by arrow 6. Operator's cab 5 is mounted on a front end of machine frame 4, and the machine frame further supports elongated ballast storage container 8 extending between the undercarriages and having bottom conveyor band 7 driven by drive 9 for conveying ballast stored in the container towards four ballast discharge chutes 10 which are arranged to discharge ballast at the field and gage sides of track rails 13.

Ballast plow carrier frame 11 is arranged below machine frame 4 between undercarriages 2, 3 and extends in the longitudinal direction. The carrier frame has one end 15 linked to the machine frame and an opposite end supported by undercarriage 12 for mobility on track 14. Ballast plow 16, 17 is vertically adjustably mounted on the carrier frame. Carrier frame end 15 is pivotal about axes extending vertically and transversely to the longitudinal direction. Center plow 16 for shaping a center portion of the ballast is connected to carrier frame 11 by a vertical adjustment drive, and vertically and transversely adjustable shoulder plowshares 17 are arranged at respective sides of the carrier frame and precede the center plow in the operating direction.

Illustrated ballast regulator 1 further comprises carrier frame 20 having front and rear ends in the operating direction, the carrier frame front end being linked at 21 to the rear end of elongated machine frame 4 for pivoting about axes extending vertically and transversely to the longitudinal direction of the elongated machine frame, and further undercarriage 22 supports the carrier frame rear end for mobility on track 14. Ballast broom 18 of ballast sweeping and receiving arrangement 19 is connected to carrier frame 20 for sweeping ballast off the track, and arrangement 19 comprises conveyor band 27 having an input end arranged to receive the ballast swept by the broom and output end 28 for discharging ballast into container 8.

Broom 18 extends transversely across track 14 below carrier frame 20 between the front and rear ends thereof, and comprises radially extending, flexible sweeping elements for sweeping ballast off the track upon rotation of the broom by drive 23 in a counterclockwise direction. Conveyor band 27 extends between ballast broom 18 and ballast storage container 8, and ascends at an angle of about 15° to about 25° with respect to a horizontal plane.

The illustrated machine further comprises ballast conveying gutter 29 mounted on carrier frame 20 above ballast broom 18. The gutter has front discharge end 30 and rear end input end 32 in the operating direction, the rear input end of the gutter being arranged above carrier frame 20 and the front discharge end of the gutter being arranged above the input end of conveyor band 27. Means 31 is connected to ballast conveying gutter 29 for imparting vibrations thereto. Ballast sweeping and receiving arrangement 19 further comprises ballast conveying chute 26 arranged below front discharge end 30 of gutter 29 and above the input end of conveyor band 27, chute 26 preceding ballast broom 18 in the operating direction for receiving ballast swept off the track by the broom. The housing of the ballast broom is mounted on the carrier frame for pivoting about axis 25 extending transversely to the longitudinal direction of elongated machine frame 4 and above ballast conveying chute 26, and hydraulic vertical adjustment drive 24 links the ballast broom housing to carrier frame 20 for pivoting ballast broom 18 about pivoting axis 25. Central power plant 34 serves to supply power to all operating drives of machine 1, including drive 35 for propelling the machine along the track.

Illustrated ballast regulator 1 further comprises operator's cab 33 mounted on carrier frame 20 adjacent the rear end thereof, rear input end 32 of gutter 29 being arranged above the cab. An operator in this cab may control the operation of the gutter and ballast sweeping and receiving arrangement 19 as well as the advance of the machine in a direction opposite to the operating direction indicated by arrow 6.

Before a ballast regulating operation begins, ballast storage container 8 is filled, for example by conveying ballast stored in a trailing silo car by conveyor 36, gutter 29 and conveyor band 27 into container 8 where it is stored on bottom conveyor band 7. Some storage capacity is kept for enabling container 8 to receive any ballast swept up by broom 18 during the operation.

At the operating site, broom 18 and ballast plow 16, 17 are lowered into their respective operating positions, carrier frame 11 is lowered by operation of device 19 and machine 1 is advanced continually in the operating direction indicated by arrow 6 by drive 35. Any excess ballast accumulating on the track is swept up by rotating broom 18 and is conveyed by ascending conveyor 27 into ballast storage container 8. When the operator in cab 5 determines that track 14 requires additional ballast, the discharge ports of all or selected chutes 10 are opened and bottom conveyor 7 is driven a short distance to discharge stored ballast from container 8 onto the track. If the ballast storage container is emptied during the operation, it can be refilled from a trailing silo car at any time by the above-described operation of conveyors 36 and 27.

What is claimed is:

1. A mobile machine for distributing and planing ballast supporting a track, which comprises (a) an elongated machine frame supported by undercarriages on the track for mobility in an operating direction, the machine frame having a rear end in said direction, (b) a ballast plow connected to the machine frame,
(c) a ballast storage container mounted on the machine frame,
(d) a carrier frame having front and rear ends in the operating direction,
  (1) the carrier frame front end being linked to the machine frame rear end for pivoting about axes extending vertically and transversely to the longitudinal direction of the elongated machine frame, and
  (2) a further undercarriage supporting the carrier frame rear end for mobility on the track, and
(e) a ballast sweeping and receiving arrangement comprising
  (1) a ballast broom connected to the carrier frame for sweeping ballast off the track and
  (2) a conveyor band having an input end arranged to receive the ballast swept by the broom.

2. The mobile machine of claim 1, wherein the ballast broom is arranged below the carrier frame between the front and rear ends thereof.

3. The mobile machine of claim 1, wherein the conveyor band extends between the ballast broom and the ballast storage container, and ascends at an angle of about 15° to about 25° with respect to a horizontal plane.

4. The mobile machine of claim 3, further comprising a ballast conveying gutter mounted on the carrier frame above the ballast broom, the gutter having a front discharge end and a rear input end in the operating direction, the rear input end of the gutter being arranged above the carrier frame and the front discharge end of the gutter being arranged above the input end of the conveyor band.

5. The mobile machine of claim 4, further comprising means for vibrating the ballast conveying gutter.

6. The mobile machine of claim 4, wherein the ballast sweeping and receiving arrangement further comprises a ballast conveying chute arranged below the front discharge end of the gutter and above the conveyor band input end, the chute preceding the ballast broom in the operating direction for receiving ballast swept off the track by the broom.

7. The mobile machine of claim 6, wherein the ballast broom is mounted on the carrier frame for pivoting about an axis extending transversely to the longitudinal direction of the elongated machine frame and above the ballast conveying chute, further comprising a vertical adjustment drive linking the ballast broom to the carrier frame for pivoting the broom about the pivoting axis.

8. The mobile machine of claim 4, further comprising an operator's cab mounted on the carrier frame adjacent the rear end thereof, the rear input end of the gutter being arranged above the cab.

* * * * *